United States Patent [19]

Hasegawa et al.

[11] Patent Number: 4,469,771

[45] Date of Patent: Sep. 4, 1984

[54] ELECTROPHOTOGRAPHIC LIGHT-SENSITIVE MEMBER WITH THIN OVERLAYER

[75] Inventors: Haruo Hasegawa, Kawasaki; Kenji Seki, Yokohama; Hideaki Ema, Kawasaki; Masahide Harada, Tokyo; Shiro Yamane, Yokohama, all of Japan

[73] Assignee: Ricoh Co., Ltd., Tokyo, Japan

[21] Appl. No.: 362,176

[22] Filed: Mar. 25, 1982

Related U.S. Application Data

[60] Continuation of Ser. No. 130,275, Mar. 14, 1980, abandoned, which is a division of Ser. No. 877,369, Feb. 13, 1978, Pat. No. 4,225,648, which is a continuation of Ser. No. 737,847, Nov. 11, 1976, abandoned.

[30] Foreign Application Priority Data

Nov. 11, 1975 [JP] Japan ..... 50-134695

[51] Int. Cl.[3] ..... G03G 5/14; G03G 13/22

[52] U.S. Cl. ..... 430/126; 430/58; 430/66

[58] Field of Search ..... 430/58, 66, 126, 81

[56] References Cited

U.S. PATENT DOCUMENTS

| | | | |
|---|---|---|---|
| 3,928,034 | 12/1975 | Regensburger | 430/58 X |
| 3,989,520 | 11/1976 | Rochlitz | 430/58 |
| 4,069,046 | 1/1978 | Hoegl et al. | 430/81 |
| 4,088,483 | 5/1978 | Isono et al. | 430/66 |

*Primary Examiner*—Roland E. Martin, Jr.

*Attorney, Agent, or Firm*—Flynn, Thiel, Boutell & Tanis

[57] ABSTRACT

Electrophotographic light-sensitive member having a protective coating on a photoconductive layer of the light-sensitive member, said protective coating consisting of an organic high polymer containing Lewis acid.

1 Claim, No Drawings

ELECTROPHOTOGRAPHIC LIGHT-SENSITIVE MEMBER WITH THIN OVERLAYER

This is a continuation of application Ser. No. 130,275, filed Mar. 14, 1980, abandoned, which in turn is a division of application Ser. No. 877,369, filed Feb. 13, 1978, now U.S. Pat. No. 4,225,648, which in turn is a continuation of application Ser. No. 737,847, filed Nov. 11, 1976, now abandoned.

BACKGROUND OF THE INVENTION

An electrophotographic light-sensitive member consists essentially of a photoconductive layer formed on an electroconductive support. The photoconductive layer consists of, for example, amorphous selenium or zinc oxide-resin coatings, and the electroconductive support consists of, for example, a metal plate or a metal-coated resin film.

In one of the electrophotographic processes, the following steps (1) to (5) are usually involved:

(1) Sensitizing the photoconductive layer by a corona discharge.

(2) Exposing the photoconductive layer to form an electrostatic latent image.

(3) Developing the latent image with charged fine particles, i.e. toners.

(4) Transferring the developed image to other material such as paper, and (5) Fixing the image to the paper by fusing or by virtue of the self-fixing quality of the toner.

In the electrophotographic process, some of the toner usually remains on the photoconductive layer after the transferring of the developed toner image. The remaining toner should be removed to carry out the next process. The removal of the remaining toner, i.e. the cleaning of the photoconductive layer, is performed by "brushing". The photoconductive layer receives scratches on the surface by the developing, transferring and cleaning steps. The scratches increase by repeating the process. These scratches have a bad effect on the formation of the toner image, and therefore a vivid copy cannot be obtained.

In order to obviate the defects as stated above, there has been proposed the formation of a protective coating on a photoconductive layer. As material of the protective coating, the following high polymers are conventionally employed: polystyrene, poly-n-butyl methacrylate, polyamide, polyester, polyurethane, polycarbonate, polyvinylformal, polyvinyl acetal, polyvinyl butyral, ethyl cellulose, nitrocellulose and acetylcellulose.

In order to protect the photoconductive layer and increase the durability of the light-sensitive member, a thick protective coating is required. However, the thick protective coating gives low resolution. The resolution is expressed as the number of lines per millimeter (lines/mm). Amorphous selenium can give a resolution of 7 to 9 lines/mm. However, amorphous selenium having a protective coating of the organic high polymer as shown above gives various resolutions dependent on the thickness of the coating as follows:

| Thickness of protective coating | Resolution |
|---|---|
| 0.5μ | 5–8 lines/mm |
| 1μ | 4–6 lines/mm |
| 2μ | 3–5 lines/mm |

It is understood that the resolution depends on the kind of organic high polymer employed. As can be seen in the above, high resolution usually can be obtained if the protective coating is less than 0.5μ in thickness. When such a thin protective coating is used, however, high durability cannot be obtained, namely, the number of the printed copies which can be obtained is less than twenty thousand.

It is an object of the present invention to provide electrophotographic light-sensitive members which have high durability and resolution.

SUMMARY OF THE INVENTION

The present invention relates to an electrophotographic light-sensitive member having a protective coating on a photoconductive layer, said protective coating comprising an organic high polymer and Lewis acid.

The electrophotographic light-sensitive members have a protective coating of from 0.5μ to 15μ in thickness, and have high resolution such as more than 5 lines/mm and high durability which can give about thirty thousand copies of the printed matter.

Preferred Lewis acids used in the protective coating are as follows:

2,3-dichloro-5,6-dicyano-p-benzoquinone, dicyanomethylene, tetracyanoethylene, 2,6-dinitro-p-benzoquinone, tetracyano-p-benzoquinone, tetracyano-p-quinodimethane, 2,3-dicyano-p-bensoquinone, o-bromanil, o-chloranil, p-bromanil, p-chloranil, p-iodanil, trichloro-p-benzoquinone, 2,6-dichloro-p-benzoquinone, 2,5-dichloro-p-benzoquinone, 2,3-dichloro-p-benzoquinone, 2,4,7-trinitro-9-fluorenone, chloro-p-benzoquinone, 1,2-dicarboxy-1,2-dicyanoethylene, pyromellitic anhydride, p-benzoquinone, 1,3,5-trinitrobenzene, 2,4,6-trinitrotoluene, maleic anhydride, tetrachlorophthalic anhydride, 1,2,4,5-tetracyanobenzene, m-dinitrobenzene, 1,3,5-tricyanobenzene, 2,4-dinitrobenzoic acid, 3,5-dinitrobenzoic acid, 4,4'-bis (dimethyl-amino)benzophenone, tetrachlorophthalic anhydride, picric acid, 4-nitro benzaldehyde, 2-acetylnaphthalene, phthalic acid and a mixture thereof.

By mixing Lewis acid as shown above in the protective coating of organic high polymer, only resolution of the photoconductive layer can be improved, or both resolution and light decay property of the photoconductive layer can be improved.

Lewis acids are preferably contained in an amount of 0.1 to 20% by weight in the organic high polymer. The amount of the Lewis acids depends on the kind of the organic high polymer used. If an amount of less than 0.1% by weight is employed, improvement of the resolution cannot be detected, and if an amount of more than 20% by weight is employed, the desired durability of the protective coating cannot be obtained because the mechanical property of the protective coating deteriorates.

The following organic high polymers are used as a material of the protective coating: polyamide, polyester, polyurethane and other organic high polymers which can form a coating, for example polystyrene, poly-n-butylmethacrylate, polycarbonate, polyvinylformal, polyvinylacetal, polyvinylbutyral, ethylcellulose, nitrocellulose and acetylcellulose.

Thickness of the protective coating is in the range of 0.5 to 15μ. If the thickness is less than 0.5μ, satisfactory durability cannot be obtained. On the contrary, if the thickness is more than 15μ, resolution of the toner image decreases and contamination of the copy increases.

As a material of the electroconductive support, metals such as aluminium, zinc, brass, copper, tin and nickel, and other electroconductive substance such as polyvinyl alcohol can be used. Metal-coated paper or plastic film may be used as the electroconductive support.

The protective coating of the present invention can be applied to the photoconductive layer as shown below: (1) a photoconductive layer consisting essentially of amorphous selenium, (2) a photoconductive layer consisting essentially of a mixture of a photoconductive substance such as zinc oxide, titanium oxide, zinc sulfide, cadmium sulfide, cadmium selenide and copper phthlocyanine, and a binding agent such as silicone resin, acrylic resin, alkyd resin, styrene-butadiene copolymer, and (3) a photoconductive layer consisting essentially of an organic photoconductive substance such as N-vinylcarbazole, oxazole, triazole, imidazol, pyrazoline and derivatives thereof and polymers thereof.

The photoconductive layer as shown above may be a single layer or a multiple layer of more than two layers. A barrier layer may intervene between the photoconductive layer and the electroconductive layer, said barrier layer condisting essentially of a thin layer of aluminium oxide or a synthetic resin.

In the protective coating of the present invention, other additives such as pigment, dye and hardener may be contained.

DESCRIPTION OF THE PREFERRED EMBODIMENTS

The following examples are given by way of illustration only:

EXAMPLE 1.

A barrier layer of polyamide of 0.1μ in thickness was formed on an aluminium support of 0.2 mm in thickness, and then selenium was vacuum evaporated on the barrier layer to form a photoconductive layer of 50μ in thickness. A solution of 10 g of cellulose propionate (sold by Eastman Kodak under the trademark of HSP) and 0.6 g of 2,4-dinitrobenzoic acid (Lewis acid) dissolved in a mixture of 60 g of butyl acetate and 20 g of ethyl acetate was coated on the photoconductive layer by dipping and dried with warm air of 40° C. for one hour to form a protective coating of 2μ in thickness on the photoconductive layer. In this way, an electrophotographic light-sensitive member (No. 1) having the protective coating of the present invention was obtained.

A control electrophotographic light-sensitive member (No. 2) was obtained by repeating the same procedure as that described above except that a protective coating was formed in thickness of 2μ by using cellulose propionate only.

Electrostatic properties and resolution of two electrophotographic light-sensitive members (No. 1 and No. 2) were measured in an atmosphere of 20±5° C. and 50±10% RH (relative humidity), and Vs, Vo, $E_{1/10}$, $V_{p30}$ and resolution were obtained as follows:

| Testing machine | Paper Analyser SP 428 sold by Kawaguchi Denki K.K. |
|---|---|
| Voltage of corona discharge | +6kV or −6kV |
| Current of corona discharge | 10 μA |
| Vs Acceptance potential (V) of photoconductive layer | Potential after corona discharge for 20 seconds |
| Vo Surface potential (V) of photoconductive layer | Potential after standing in dark for 20 seconds after discontinuance of corona discharge |
| $E_{1/10}$: *Amount of exposure* (lux · sec) | Exposure in illuminance of 10/7 lux required to reduce the surface potential to one tenth of its original value (Vo) |
| $V_{p30}$: *Surface potential (V)* | Potential after exposure in illuminance of 10/7 lux for 30 seconds |
| Resolution: (lines/mm) | The resolution test was effected by using "Image Testing Machine" |

The results obtained are shown in the following Table-1:

TABLE 1

| Light-sensitive member | Vs (V) | Vo (V) | $E_{1/10}$ (lux · sec) | $V_{p30}$ (V) | Resolution (lines/mm) |
|---|---|---|---|---|---|
| No. 1 | 1180 | 870 | 12.6 | 28 | ↑ |
| No. 2 | 1170 | 860 | 12.5 | 27 | ↓ |

As can be seen from the results, light-sensitive members (No. 1 and No. 2) are similar in their electrostatic properties, but the light-sensitive material (No. 1) of the present invention is superior to the control light-sensitive member (No. 2) in the resolution.

EXAMPLE 2.

Selenium was vacuum evaporated on an aluminium support of 0.2 mm in thickness to form a first photoconductive layer of 1.5μ in thickness and then a 10% chlorobenzene solution of brominated poly-N-vinylcarbazole was coated on the first photoconductive layer and dried to form a second photoconductive layer of 10μ in thickness. A solution of 10 g of nitrocellulose (sold by Daicel Ltd. under the trademark SS½) and 0.4 g of p-bromanil (Lewis acid) dissolved in a mixture of 50 g of methyl alcohol and 50 g of ethyl alcohol was coated on the second photoconductive layer by dipping and dried with warm air of 40° C. for 10 minutes to form a protective coating of 3μ in thickness on the photoconductive layer. In this way, an electrophotographic light-sensitive member (No. 3) of the present invention was obtained.

A control electrophotographic light-sensitive member (No. 4) was obtained by repeating the same procedure as that described above except that a protective coating was formed in thickness of 3μ by using nitrocellulose only.

Electrostatic properties and resolution of two light-sensitive members (No. 3 and No. 4) were measured in the same manner as that of Example 1 except that voltage of −6 kV was applied in corona discharge and toners having a positive polarity was used.

The results obtained are shown in the following Table-2:

TABLE 2

| Light-sensitive member | Vs (V) | Vo (V) | $E_{1/10}$ (lux · sec) | $V_{p30}$ (V) | Resolution (lines/mm) |
|---|---|---|---|---|---|
| No. 3 | −1650 | −1350 | 12.5 | 16 | 8 |
| No. 4 | −1660 | −1360 | 12.5 | 16 | 4 |

As can be seen from the results, light-sensitive members (No. 3 and No. 4) are similar in the electrostatic properties, but the light-sensitive member (No. 3) of the present invention is superior to the control light-sensitive member (No. 4) in the resolution.

EXAMPLE 3.

100 g of fine powder of photoconductive copper phothalocyanine was added in a solution of 150 g of epoxy resin (sold by Shell Oil Co. under the trademark of Epikote) in 600 g of methyl ethyl ketone, and the mixture was dispersed in a ball mill for 4 hours, and then to the dispersion was added 15 g of diethyltetramine (amine hardener) and the mixture was dispersed for three minutes to obtain a dispersion containing the photoconductive substance. This dispersion was coated on an aluminium support of 0.2 mm in thickness and dried with heated air of 150° C. for 20 minutes to form a photoconductive layer of 20μ in thickness on the support and the coated member was allowed to stand at room temperature for one week to harden the photoconductive layer. A solution of 1 g of tetracyano-p-quinodimethane (Lewis acid) in 100 g of tetrahydrofuran was added to 100 g of 55% solution of mineral spirit (sold by Mitsuitoatsu Chemicals, Inc. under the trademark of Olester F-77-55MS) of oil modified polyurethane resin, and further to the mixture was added 80 g of mineral spirit. The mixture thus obtained was coated on the hardened photoconductive layer by dipping and dried with warm air of 100° C. for one minute to form a protective coating of 3μ in thickness on the photoconductive layer. In this way, an electrophotographic light-sensitive member (No. 5) of the present invention was obtained.

A control electrophotographic light-sensitive member (No. 6) was obtained by repeating the same procedure as that described above except that a protective coating was formed in thickness of 3μ by using oil modified polyurethane resin only.

Electrostatic properties and resolution of two light-sensitive members (No. 5 and No. 6) were measured in the same manner as that of Example 1.

The results obtained are shown in the following Table-3:

TABLE 3

| Light-sensitive member | Vs (V) | Vo (V) | $E_{1/10}$ (lux · se) | $V_{p30}$ (V) | Resolution (lines/mm) |
|---|---|---|---|---|---|
| No. 5 | 820 | 430 | 28 | 22 | 7 |
| No. 6 | 830 | 450 | 36 | 75 | 3 |

As can be seen from the results, the electrophotographic light-sensitive member (No. 5) of the present invention is superior to the control light sensitive member (No. 6) in the electrostatic properties ($E_{1/10}$ and $V_{p30}$) and in the resolution.

EXAMPLE 4.

Selenium was vacuum evaporated on an aluminium cylinder having surface length of 283 mm and external diameter of 120 mm to form a first photoconductive layer of 50μ in thickness and then selenium (93%)-tellurium (7%) alloy was vacuum evaporated on the first photoconductive layer to form a second photoconductive layer of 5μ in thickness. 100 g of ethyl cellulose (sold by Hercules Powder Co. under the trademark K-50) was dissolved in a mixture of 200 g of ethyl acetate and 600 g of n-butyl alcohol and to this solution was added a solution of 5 g of 2,6-dinitro-p-benzoquinone (Lewis acid) in 100 g of ethyl alcohol. This mixture was coated on the photoconductive layer by an electrostatic coating method and dried at a temperature of 40° C. for 30 minutes to form a protective coating of 5μ in thickness on the photoconductive layer. In this way, an electrophotographic light-sensitive member (No. 7) of the present invention was obtained.

Three control electrophotographic light-sensitive members (No. 8, No. 9 and No. 10) were obtained by repeating the same procedure as that described above except that a protective coating was formed in thickness of 0.5μ, 1μ and 5μ, respectively, by using ethyl cellulose only.

Resolution and durability of four light-sensitive members Nos. 7, 8, 9 and 10 were measured using PPC Copying Machine DT-1200 (acid by K. K. Ricoh). The results obtained are shown in the following Table-4:

TABLE 4

| Light-sensitive member | Thickness of protective coating | Resolution (lines/mm) | Durability (the number of printed matter) |
|---|---|---|---|
| No. 7 | 5μ | 7 | 30,000 |
| No. 8 | 0.5μ | 8 | 500 |
| No. 9 | 1μ | 5 | 2,000 |
| No. 10 | 5μ | 3 | 30,000 |

As can be seen from the results: Light-sensitive member No. 8 shows resolution of 8 lines/mm. This resolution is similar to the resolution in the light-sensitive member not having a protective coating. However, this member (No. 8) has low durability. Light-sensitive member No. 9 shows low resolution and durability. Light-sensitive member No. 10 shows high durability, but very low resolution. On the contrary, Light-sensitive member No. 7 of the present invention has high resolution and durability.

We claim:

1. An electrophotographic process, which comprises the steps of:

charging the surface of an electrophotographic light-sensitive plate by applying corona discharge thereto, said electrophotographic light-sensitive plate comprising an electroconductive support, a photoconductive layer overlying said support and an outermost protective coating layer overcoating said photoconductive layer, said outermost protective coating layer having a thickness of from 0.5 to 15 microns, being thinner than said photoconductive layer and consisting essentially of nonphotoconductive, film-forming, organic polymer selected from the group consisting of polyamide, polyester, polyurethane, polystyrene, poly-n-butylmethacrylate, polycarbonate, polyvinylformal, polyvinylacetal, polyvinylbutyral, ethyl cellulose, nitro cellulose, cellulose propionate and acetyl cellulose, said polymer containing from 0.1 to 20 percent by weight of Lewis acid mixed therein, said outermost protective coating layer being effective to protect said photoconductive layer from abrasion and to provide high resolution when an electrostatic latent image thereon is developed;

then imagewise exposing said electrophotographic light-sensitive plate to form an electrostatic latent image;

then developing said electrostatic latent image by applying toner thereto;

and then transferring said developed image to another substrate and fixing the developed image on said another substrate.

* * * * *